US007118054B2

(12) United States Patent
Grimes

(10) Patent No.: US 7,118,054 B2
(45) **Date of Patent: *Oct. 10, 2006**

(54) PRESSURE DIFFERENTIAL MATERIAL TRANSPORT AND DISPOSAL SYSTEM

(75) Inventor: Richard Timothy Grimes, Loveland, CO (US)

(73) Assignee: Tommin Enterprises, LLC, Loveland, CO (US)

( * ) Notice: Subject to any disclaimer, the term of this patent is extended or adjusted under 35 U.S.C. 154(b) by 181 days.

This patent is subject to a terminal disclaimer.

(21) Appl. No.: 10/480,115

(22) PCT Filed: Jun. 5, 2002

(86) PCT No.: PCT/US02/17916

§ 371 (c)(1),
(2), (4) Date: Dec. 8, 2003

(87) PCT Pub. No.: WO02/100549

PCT Pub. Date: Dec. 19, 2002

(65) Prior Publication Data

US 2004/0173698 A1 Sep. 9, 2004

Related U.S. Application Data

(60) Provisional application No. 60/296,824, filed on Jun. 8, 2001.

(51) Int. Cl.
*B02C 18/40* (2006.01)

(52) U.S. Cl. ..... 241/19; 209/142; 241/46.013; 241/60; 241/69; 241/81

(58) Field of Classification Search ..... 241/19, 241/69, 81, 60, 61, 46.013; 209/142
See application file for complete search history.

(56) References Cited

U.S. PATENT DOCUMENTS

| | | | | |
|---|---|---|---|---|
| 3,911,944 | A | 10/1975 | Hukuba et al. | |
| 4,519,896 | A | 5/1985 | Vickery | |
| 4,903,911 | A | 2/1990 | Sepke | |
| 5,032,256 | A | 7/1991 | Vickery | |
| 5,060,342 | A | 10/1991 | Brazier | |
| 5,087,420 | A | 2/1992 | Jackson | |
| 5,119,843 | A | 6/1992 | Keenan | |
| 5,156,349 | A | 10/1992 | Wilson et al. | |
| 5,344,085 | A | 9/1994 | Hofseth | |
| 5,608,945 | A | 3/1997 | Crouser et al. | |
| 5,779,744 | A | 7/1998 | Muller et al. | |
| 5,924,163 | A | 7/1999 | Burns, Jr. | |
| 5,954,863 | A | 9/1999 | Loveless et al. | |
| 5,971,303 | A | 10/1999 | Pugh-Gottli | |
| 5,974,624 | A | 11/1999 | Bisen | |
| 5,992,430 | A | 11/1999 | Chardack | |
| 6,021,545 | A | 2/2000 | Delgado et al. | |
| 6,131,587 | A | 10/2000 | Chardack | |
| 6,233,361 | B1 | 5/2001 | Rozenblatt | |
| 6,434,783 | B1 | 8/2002 | Arnold et al. | |
| 6,691,939 | B1 * | 2/2004 | Grimes | 241/46.17 |

* cited by examiner

*Primary Examiner*—Mark Rosenbaum
(74) *Attorney, Agent, or Firm*—CR Miles P.C.; Craig R. Miles

(57) ABSTRACT

A pressure differential material transport system to transfer materials with an airflow to a sewer system. Embodiments of the pressure differential material transport system may be used for residential or industrial applications to dispose of materials to the sewer or to a comminutor to reduce the size of materials prior to disposal.

92 Claims, 9 Drawing Sheets

PRESSURE DIFFERENTIAL MATERIAL TRANSPORT AND DISPOSAL SYSTEM

This application is the United States National Stage of International Patent Application No. PCT PCT/US02/17916, filed Jun. 5, 2002, and claims the benefit of Unites States Provisional Patent Application No. 60/296,824, filed Jun. 8, 2001, each incorporated by reference herein.

I. TECHNICAL FIELD

A material transport system that disposes of material separated from airflow to a sewage system. Certain embodiments of the material transport and disposal system comminute the material prior to transferring it to a sewage system.

II. BACKGROUND

Because of the convenience of using pressure differential distribution systems to move objects, materials, or substances with a pressure gradient, or within airflow, there is a large commercial market for these systems. The transfer of objects, materials, or substances with a pressure gradient along at least one path from a first zone to a second zone encompasses technology such as pneumatic tube systems, vacuum cleaning systems, emission removal systems, ventilation systems, fluid distribution systems, and the like.

Even though there is a large market for pressure differential distribution technology and numerous products have been introduced into the marketplace over the years to move or collect materials with airflow, substantial problems remain unresolved with respect to separation of materials from an airflow or disposal of materials transferred by airflow.

A significant problem with conventional pressure differential material transport technology may be that it does not directly dispose of materials to a sewage system. For example, conventional vacuum cleaner technology collects material flowably responsive to airflow in a receptacle or canister. The collected material is subsequently removed from the vacuum cleaner and disposed of separately (typically in the trash subsequently transferred to a landfill). With respect to wet applications, "wet-vacuums" provide conventional vacuum cleaner technology in which liquids are collected in a liquid trap or canister to isolate the liquid a distance away from the pressure differential generator or vacuum pump and associated electrical connections as disclosed by U.S. Pat. Nos. 5,954,863; 5,779,44; 5,608,945; 5,954,863; 5,924,163, and 5,974,624, each hereby incorporated by reference. Liquids along with materials suspended in the liquid collected in the liquid trap or canister are then removed or poured from the canister to a sink or drain.

Another significant problem with conventional pressure differential material transport technology may be that airflow within which material is transferred must be discontinued to separate the material from the airflow, or to remove materials collected in a canister, bag, receptacle, or liquid trap. This interruption of airflow may represent an annoyance or inconvenience to the user with respect to some applications, such as turning off a vacuum cleaner to empty the material collection receptacle, however, the interruption of airflow may be represent a significant event in a manufacturing operation that cannot operate a process system without airflow to transfer material, substances, or objects, or cannot operate a process system without continuous disposal of material transferred with airflow.

Another significant problem with conventional pressure differential material transport technology may be that material flowably responsive to airflow is not comminuted or divided into pieces of sufficiently small size to be transferred to a sewage system. One aspect of this problem may be that the comminutor, which in certain applications may be a conventional household garbage disposer, is not compatible with receiving material transferred with airflow. This incompatibility may be mechanical as the conventional comminutor may not have a inlet compatible with a material transfer conduit that conducts airflow, or the incompatibility may be that the conventional comminutor is not configured to separate material transferred in an airflow, or the incompatibility may be that the comminutor is not configured to properly vent airflow away from the comminutor.

Another significant problem with conventional pressure differential material transport technology may be that a vacuum or low pressure must be maintained in drain lines as disclosed by U.S. Pat. No. 6,223,361, hereby incorporated by reference. However, maintenance of such a vacuum or low pressure in drain lines may not be possible when disposing of material in an airflow to a sewage system or comminutor.

Relating to pressure differential distribution material transport technology in general, and liquid material transport systems specifically, it can be understood there are an array of problems that should be addressed yet remain unresolved. The present invention addresses each the above-mentioned problems and provides practical solutions.

III. DISCLOSURE OF THE INVENTION

Accordingly, the present invention includes a variety of aspects that may be selected in different combinations based upon the particular application or needs to be addressed. Naturally, as a result of these several different and potentially independent aspects of the invention, the objects of the invention are quite varied.

A principle object of embodiments of the invention can be to provide transfer of flowable material with an airflow, whether solid material or liquids. For example, without limiting the scope of the invention, the transfer of water, particulates, food, or any material or substance or combination of materials or substances that can be transferred from a surface location with an airflow.

Another principle object of embodiments of the invention can be to provide transfer of flowable material with airflow to a sewer system. A sewer system can be a conduit for carrying off wastewater and refuse, for example the sewer system of a town or a city. A sewer system can also include a septic tank to which solid and liquid organic waste can be transferred for decomposition by bacterial action or a septic system in which the septic tank conducts decomposed organic waste to a leach field.

Another principle object of embodiments of the invention can be to provide transfer of material with airflow to a comminutor. A comminutor divides material into smaller portions or pieces and can include, for example, a garbage disposer such as those used under a kitchen sink or used in industry that utilize rotating projections, blades, hammers, or the like, to crush, pulverize, grind or otherwise reduce the size of material. However, it is to be understood that this example is not meant to be limiting but rather illustrative of the various devices that comminute material.

Another principle object of embodiments of the invention can be to separate material from airflow. A first aspect of this object of the invention can be to separate material flowably responsive to airflow from the airflow prior to entry into a sewer system or cominuator. This may involve altering airflow characteristics such as velocity, volume, or direction and in some embodiments of the invention the altered airflow characteristics can allow separation of the material from the airflow due to the influence of gravity alone while in other embodiments of the invention the airflow can be directed against a surface on which material collects due to adhesive forces. A second aspect of this object can be to direct airflow to atmosphere through a vent or other conduit to reduce or avoid conducting airflow to a comminutor or sewer system.

Another principle object of embodiments of the invention can be to address the long felt but unresolved need to provide a pressure differential material transport system that can be used in the kitchen, pantry, or food preparation area to remove flowable materials from surfaces and transfer them to the garbage disposer or sewer system. The flowable materials transferred can be either solid or liquid materials, such as, food, or water, but could be water or cleaning solutions used on surfaces such as floors, walls, carpets, upholstery, counter surfaces, glazing, or the like. The present invention fulfills this long-felt need by providing an inexpensive pressure differential material transport system that can, for example, be installed under the kitchen sink.

Another broad object of embodiments of the invention can be to provide a pressure differential material transport system having surface interface elements. One aspect of this broad embodiment of the invention can be to have surface interface elements configured to direct airflow across a surface which can be flat, such as a counter surface, wall surface, floor surface, or glazing surface; or can be uneven such as a sink surface or appliance surface; or conformable such as carpeted surface or upholstered surface. Another aspect of this broad object of the invention can be to provide surface interface elements that are conformable to at least a portion of a surface such as a squeegee, a brush, a cleaning pad(s), or a buffing pad(s).

Naturally further objects of the invention are disclosed throughout other areas of specification and claims.

IV. BRIEF DESCRIPTION OF THE DRAWINGS

V. MODE(S) FOR CARRYING OUT THE INVENTION

The invention involves a pressure differential material transport system for transfer of material(s) flowably responsive to airflow. While various embodiments of the invention are described for use in the residential or home setting, these examples are meant to be illustrative of how to make and how to use the numerous embodiments of the invention with respect to the transfer of materials in the residential, commercial, or manufacturing environment with an airflow to a sewer system, septic system, or other material containment area as a manner of disposal.

Figure 1:
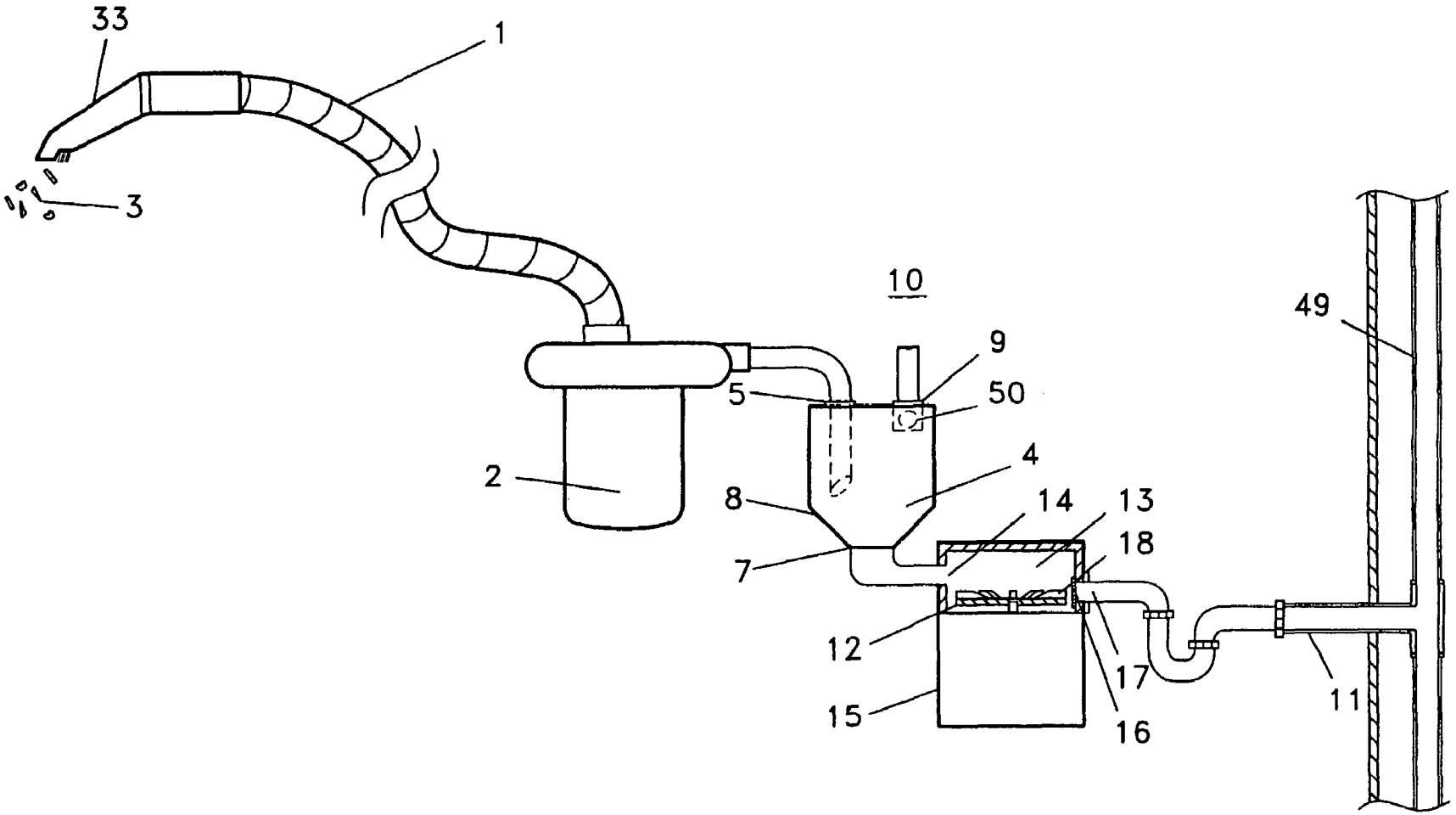
FIG. 1 shows a basic embodiment of the pressure differential material transport system invention.

Now referring primarily to FIG. 1, basic embodiments of the invention can comprise a material transfer conduit (1) having an internal volume fluidically coupled to a pressure differential generator (2). The material transfer conduit (1) can be of any configuration that allows generation of airflow within the internal volume of the material transfer conduit (1) to which flowable material (3) can be responsive. Airflow characteristics such as volume of airflow, velocity of airflow, or direction of airflow can be adjusted by configuration of the material transfer conduit (1), or the configuration or operation of the pressure differential generator (2), separately or in combination. Various types of material can be selected from which to make the material transfer conduit and can depend on for example the of air flow characteristics necessary or desired, temperature of the airflow or flowable material(s), or type(s) of material(s) transferred within the internal volume of the material transfer conduit but several none limiting examples are metal foil, plastic, rubber, fiberglass, silicon impregnated fiberglass, neoprene-polyester, silicon rubber, neoprene rubber, Kevlar, glass yarn, ceramic filler, high temperature glass, or the like, independent of one another, or in combination, or as composites. Particular embodiments of the invention can include a material transfer conduit that is a flexible hose, which for embodiments of the invention used in residential or household applications can have an external diameter of between about three-quarters inch and about one and one-half inches with an internal diameter somewhat less than the external diameter.

Figure 2:
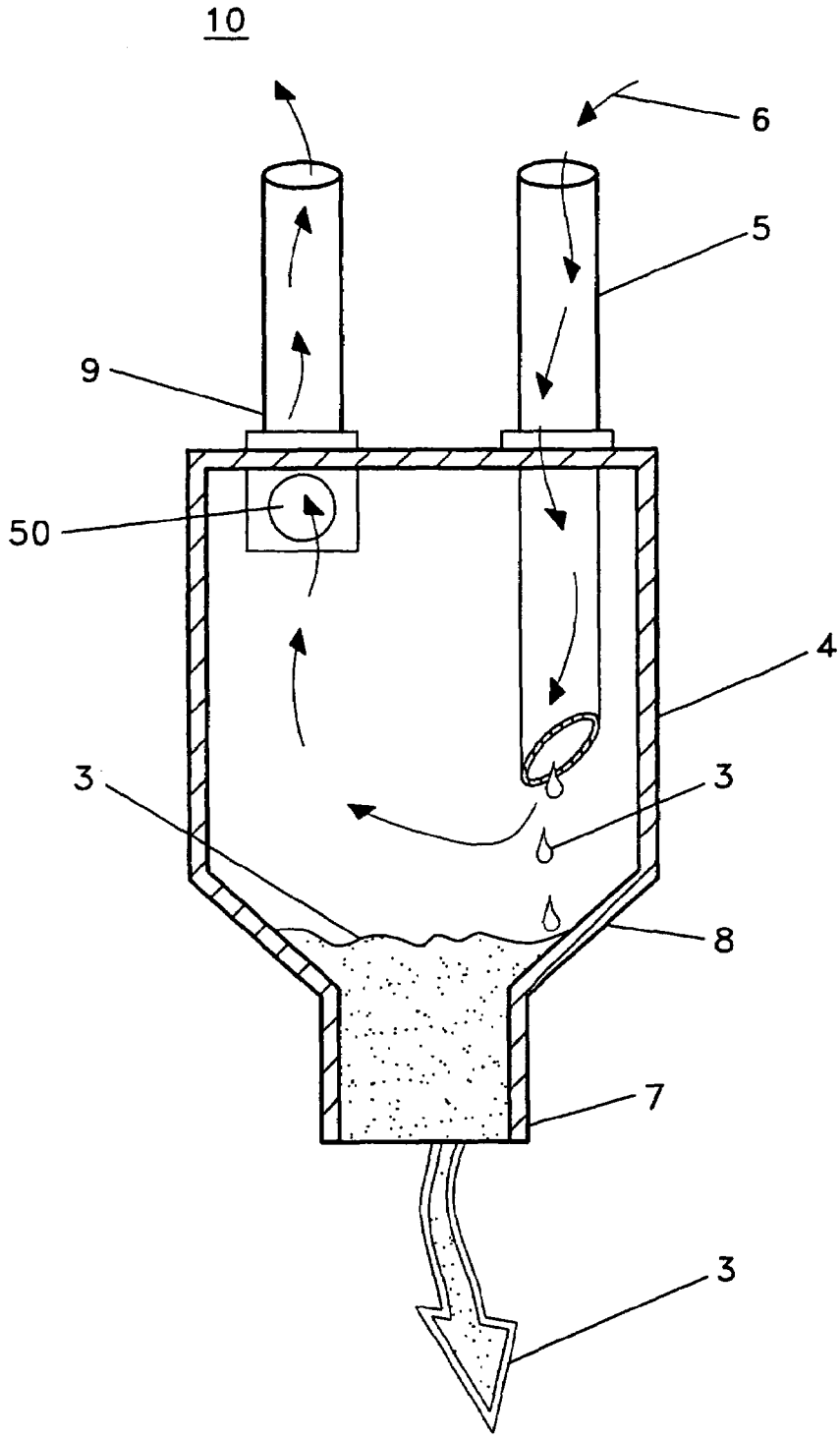
FIG. 2 shows a particular embodiment of a material separator according to the invention.

Now referring primarily to FIGS. 1 and 2, basic embodiments of the invention can further comprise a material separator (4) coupled to the material transfer conduit (1) or to the pressure differential generator (2). The material separator (4) can alter airflow characteristics to allow at least some material to separate from the airflow. Airflow transferring flowable material can be introduced into the material separator (4) configured to have an internal volume that reduces airflow velocity sufficiently to allow the force of gravity to separate the material from the airflow. Certain embodiments of the material separator can be configured to change the direction of the airflow within the material separator, which in certain applications directs the airflow against the side walls of the material separator (4) allowing forces of adhesion to assist the force of gravity in separating material from the airflow.

Specifically, as shown by FIG. 1 the configuration of a material separator (4) can be substantially cylindrical having an inlet (5) through which airflow (6) transfers material into the material separator (4), and a material outlet (7) through which separated material can be conducted. Certain embodiments of the material separator (4) can have a conical side walls (8) to direct separated material to the material outlet (7). The material separator can further comprise an airflow outlet (9) to return a portion of the airflow (6) to atmosphere (10). To reduce, avoid, or prevent the transfer of material from the airflow outlet (9) the material separator (4) can further comprise a closure (50) sealably responsive to liquid that pools or foam generated within the material separator (4). The airflow from the airflow outlet (9) can be vented directly to atmosphere (10) or can be conducted through a conduit to terminate at a specific location, such as the exterior wall of a building or above the roof of a building. In certain embodiments of the invention the airflow from the airflow outlet (9) can be conducted to the vent stack (49) of a drain system. Additional closures (51) as necessary to prevent ingress of small animals or insects or to prevent the ingress of odors from the sewer system can be installed.

While the pressure differential generator (2) as shown by FIG. 1 can be coupled either to the material transfer conduit (1) on the inlet side of the material separator (4) in which case the pressure generator can establish a portion of the internal volume of the material transfer conduit (sealing elements substantially prevent liquids and particles from contacting the turbine or rotation means of the pressure differential generator), the pressure differential generator (2) can alternately be coupled to the airflow outlet (9) of the material separator (4) to draw airflow transferring flowable material to the material separator (4).

Again referring to FIGS. 1 and 2, basic embodiments of the invention can further comprise a sewer system (11) fluidically coupled to the material outlet (9) of the material separator (4). Coupling the sewer system (11) to the material separator (4) allows materials, whether liquids or solids, that can be directly conducted to the sewer system (11) to be disposed without the necessity of a separate step of manually pouring collected material or liquids from a collection receptacle. As such materials can be continuously transferred by airflow (6) to the material separator (4) and automatically and continuously disposed to the sewer system (11). Since a substantial portion of the airflow can be conducted to the airflow outlet (9), wet traps or plumbing configurations designed to prevent sewer gases from backing up are not functionally disrupted.

Figure 3:
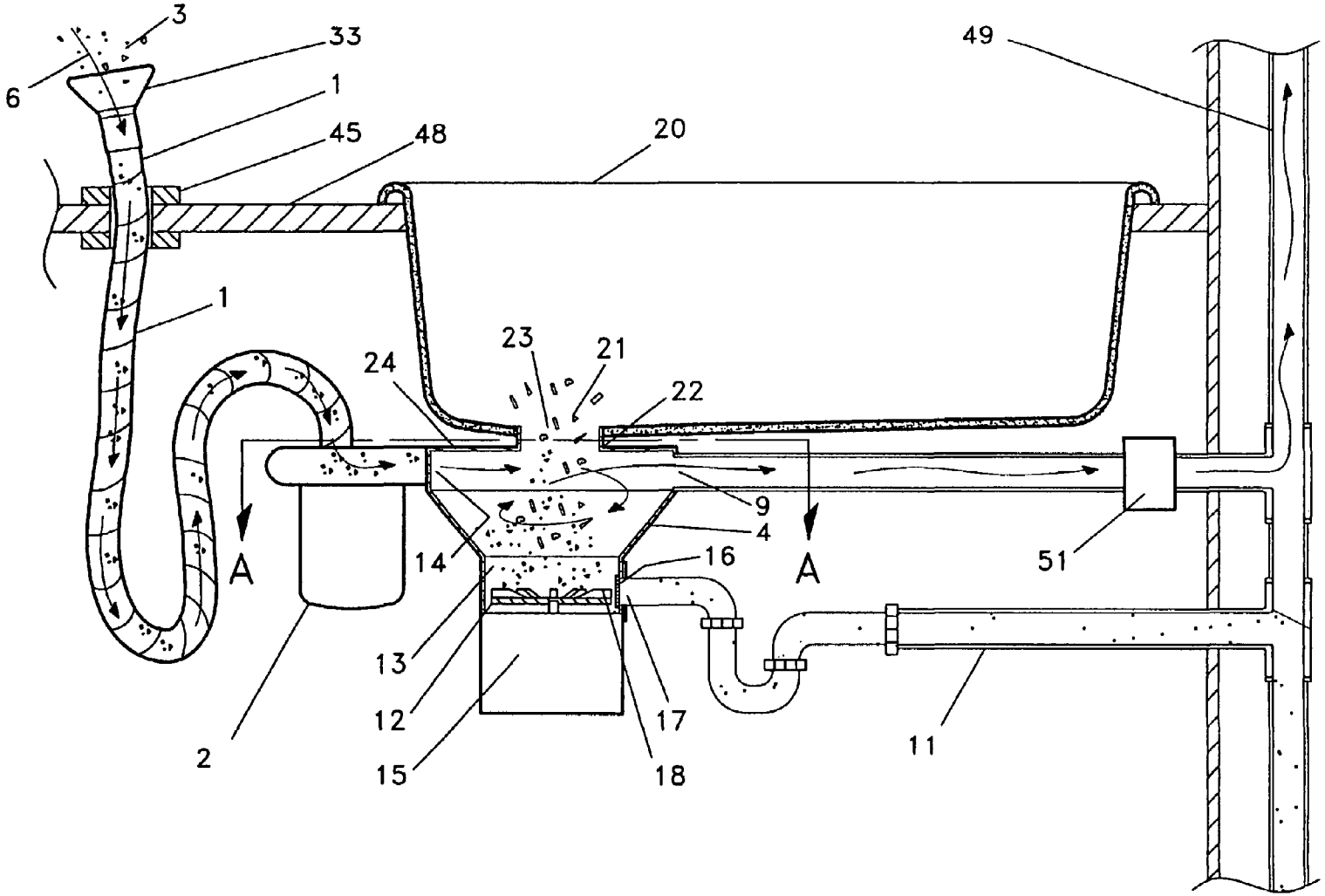
FIG. 3 shows a particular embodiment of the pressure differential material transport system invention with the pressure differential generator located prior to the inlet of the material separator.

Now referring primarily to FIG. 3, embodiments of the invention can further comprise a comminutor (12) to divide material(s) separated from airflow (6) into pieces sufficiently small to be compatible with the sewage system (11). The comminutor (12) can be located within a comminutor chamber (13) having a comminutor chamber inlet (14) fluidically coupled to the material outlet (7) of the material separator (4). A comminutor drive assembly (15) can be coupled to the comminutor (12) to move the component parts of the comminutor (12) to divide the separated material (3) into smaller pieces. With respect to certain embodiments of the invention, the comminutor chamber (13) can have substantially vertical cylindrical configuration with a comminutor (12) that comprises a circular disk having at least one comminuation element (18) attached, such as projections, blades, centrifugal hammers, or the like. The comminutor drive assembly (15) drives the comminutor, such as rotating the circular disk about a vertical axis in the cylindrical comminutor chamber (13) causing the blades, or other comminuation element to comminute the material (6) introduced into the comminutor chamber (13).

The invention can further comprise a screen element (16) located between the comminutor chamber inlet(s) (14) and the comminutor chamber outlet(s) (17). The screen element can have a plurality of apertures to allow material reduced to a size smaller than the largest of the plurality of apertures to pass through the comminutor chamber outet(s) (17). The screen element (16) can be located sufficiently close to the comminuation element(s) (18) to shear material (3) between the screen element (19) and the comminuation element(s) (18). As to certain embodiments of the invention, the comminutor chamber (13), the comminutor (12), and the comminutor drive assembly (15) can comprise a garbage disposal, such as those familiar in household kitchens.

Figure 4:
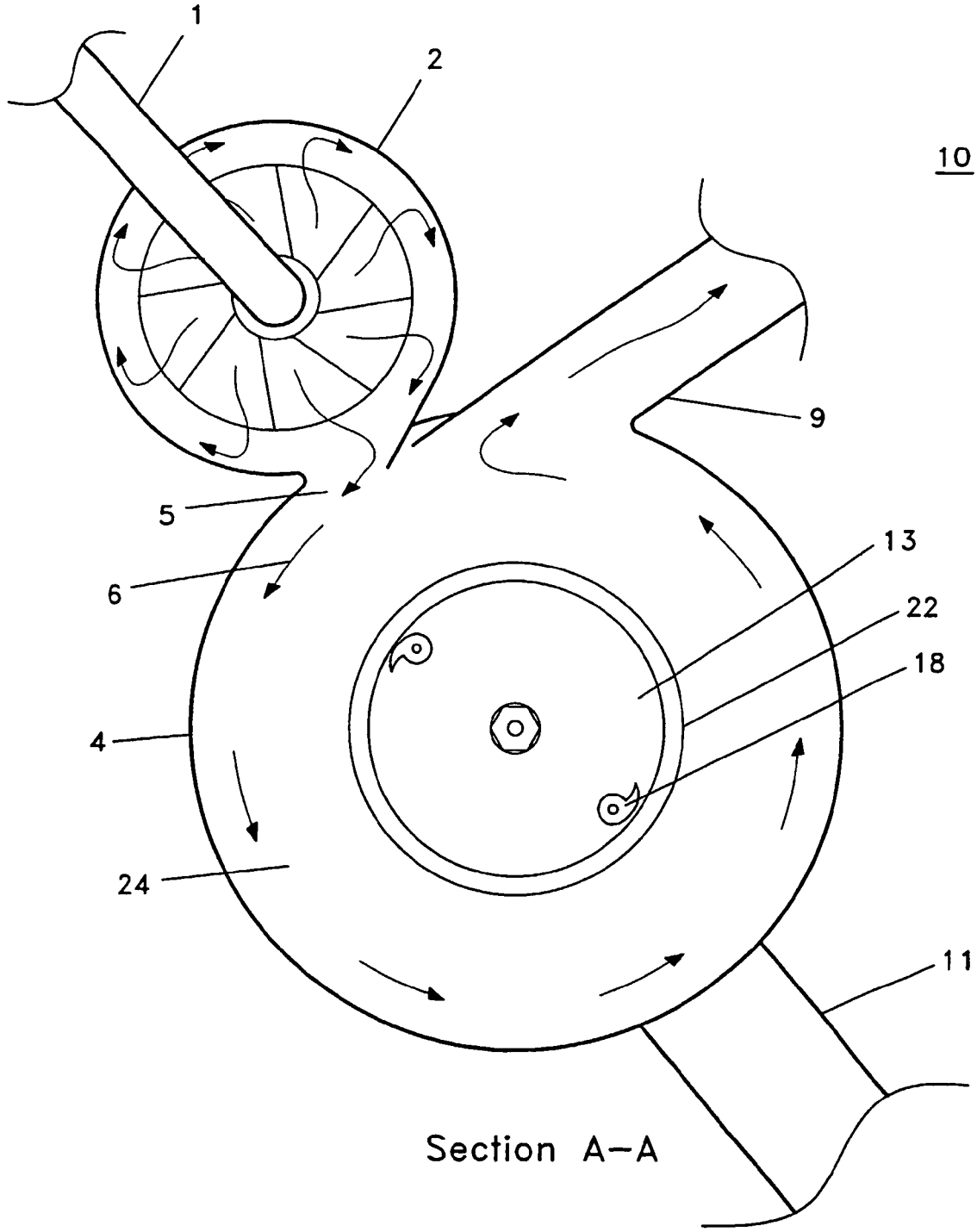
FIG. 4 shows a top view of a particular embodiment of the material separator configured to have the pressure differential generator located prior to the inlet of the material separator.

Now referring primarily to FIGS. 3 and 4, certain embodiments of the invention can be configured to further include a sink bowl (20) having a material receiving interior, such as a residential or kitchen sink, which may be supported by a counter surface. With respect to such embodiments the comminutor chamber (13) can further include a second comminuator chamber inlet and a second material transfer conduit coupled to the sink bowl (20) whereby waste material (21) collected in the sink bowl (20) can be transferred through the second material transfer conduit to the comminutor chamber (13).

Importantly, configurations of the material separator (4) can be coupled between the sink bowl (20) and the comminutor chamber (13) to provide the second material transfer conduit through which waste material (21) received by the material receiving interior of the sink bowl (20) can be transferred to the comminutor chamber (13) through the internal volume of the material separator (4). As shown by FIG. 4, embodiments of the material separator (4) that serve as the fluidic couple between the sink bowl (20) and the comminuator chamber (13) as well as a portion of the fluidic coupling between the material transfer conduit (1) and the comminuator chamber (13) can be configured to receive airflow (6) having airflow characteristics that transfers flowable material (3). These airflow characteristics are altered as described above to allow separation of material (3) from the airflow (6). Separated material (3) can then be conducted through the internal volume of the material separator (4) to the comminutor chamber (13).

Now referring primarily to FIG. 3, in those embodiments of the material separator (4) that fluidically couple a sink bowl (19) to the comminuator chamber (13) and where the pressure differential generator (2) is coupled to the material transfer conduit (1) on the inlet side of the material separator (4), or establishes a portion of the internal volume of the material transfer conduit on the inlet side of the material separator (4), the material separator (4) can be configured to provide second material transfer conduit (22) that mates with the waste material outlet (23) of the sink bowl (20). The configuration of the top (24) of the material separator (4) can be defined by the side walls of the material separator which can be substantially cylindrical side walls or conically tapered side walls, or a combination thereof, that terminally mate with the comminutor chamber (13).

Air flow (6) generated in the material transfer conduit (1) by the pressure differential generator (2) can enter the material separator (4) configured to have substantially cylindrical or conically tapered side walls in a manner in which the airflow (6) can be directed by the sidewalls for a distance prior to being vented to atmosphere through the airflow outlet (9). The airflow outlet can conduct airflow to the exterior of a building or to the vent stack of the sewer system (25). As can be understood, airflow characteristics can be altered in the material separator to allow material (3) to be separated from airflow (6) by the force of gravity or by adhesive forces or by adhering to the sidewalls of the material separator (4), or a combination thereof. Separated materials (3) are transferred by gravity or by liquids entering the material separator (4) to the comminutor chamber (13) where transferred material (3) can be divided into pieces sufficiently small to be transferred to the sewer system (11) or other waste containment element.

Figure 5:
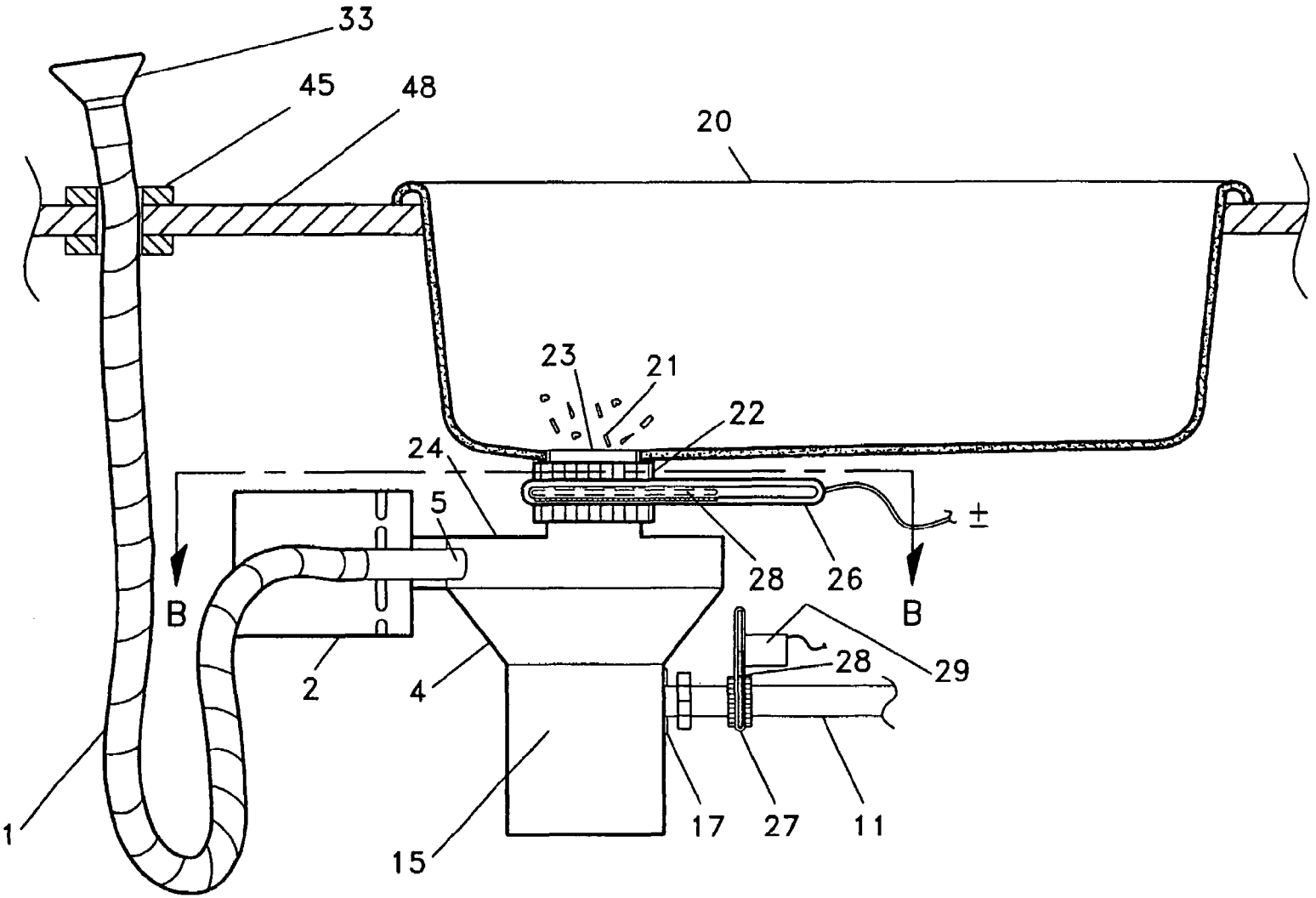
FIG. 5 shows a particular embodiment of the pressure differential material transport system invention with the pressure differential generator located after the airflow outlet of the material separator.
Figure 6:
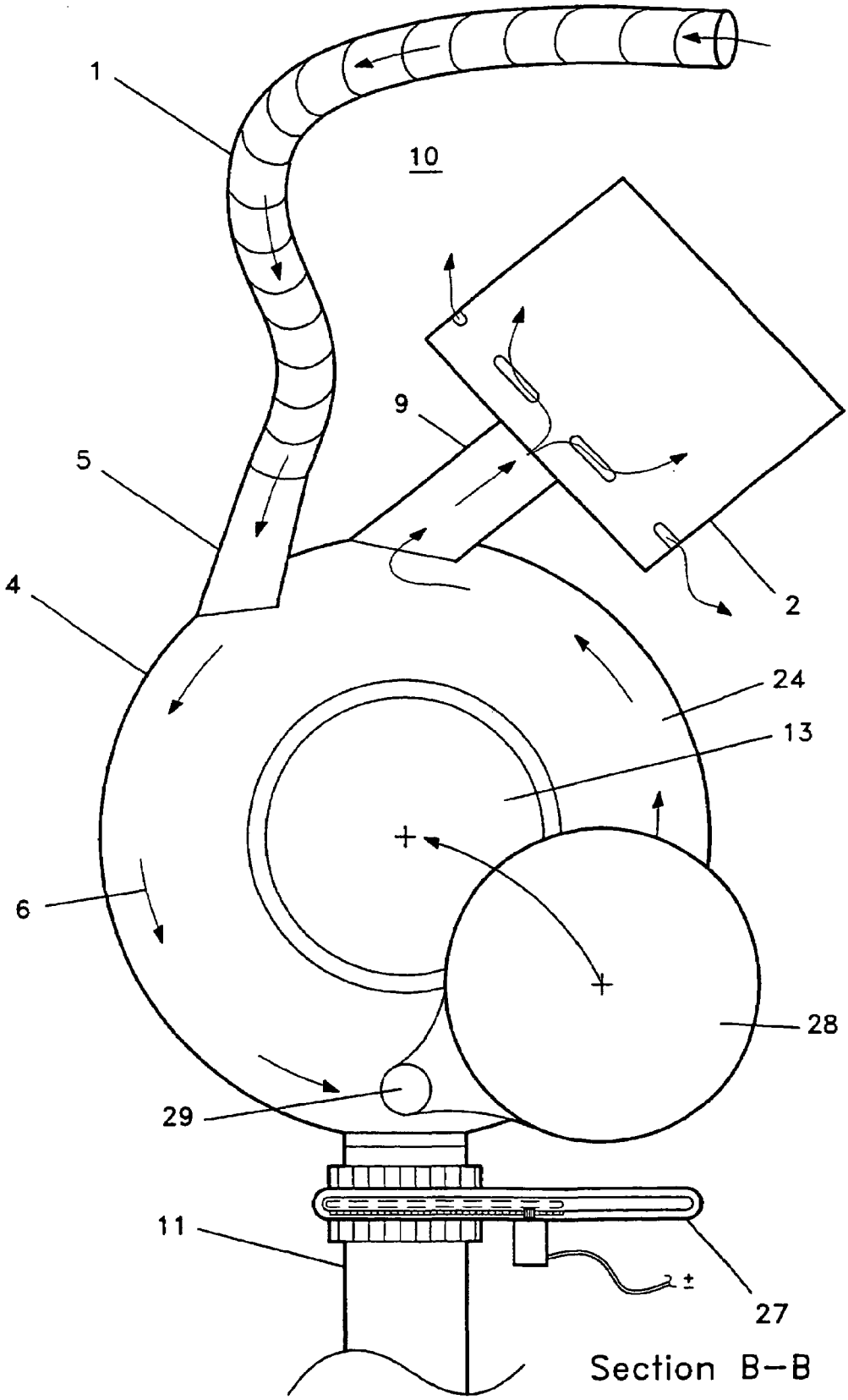
FIG. 6 shows a top view of a particular embodiment of the material separator configured to have the pressure differential generator located after the airflow outlet of the material separator and further including closures to isolate the comminutor from a sewer system or a sink basin, or both.

Now referring primarily to FIGS. 5 and 6, the invention can further include a first closure (26) between the sink bowl (20) and the material separator (4) and in certain embodiments of the invention a second closure (27) between the comminutor chamber (13) and the sewer system (11). As shown by FIG. 6, the closure(s) (26)(27) can have a rotation axis about which a closure plate (28) rotates in response to operation of a closure drive (29). The first or second closure(s) (26)(27) can be operably coupled to actuation of the pressure differential generator (2). The first closure can serve to protect the user from material (3) or airflow (6) discharged toward the second material transfer conduit (22) or sink bowl drain (20). The second closure (27) can sealably prevent airflow from being conducted through the sewer system (11). The use of both the first closure and the second closure can allow the pressure differential generator to draw airflow through the comminutor chamber (13) as shown by FIGS. 5 and 6 providing an alternative embodiment of the invention to that shown by FIGS. 3 and 4.

Figure 7:
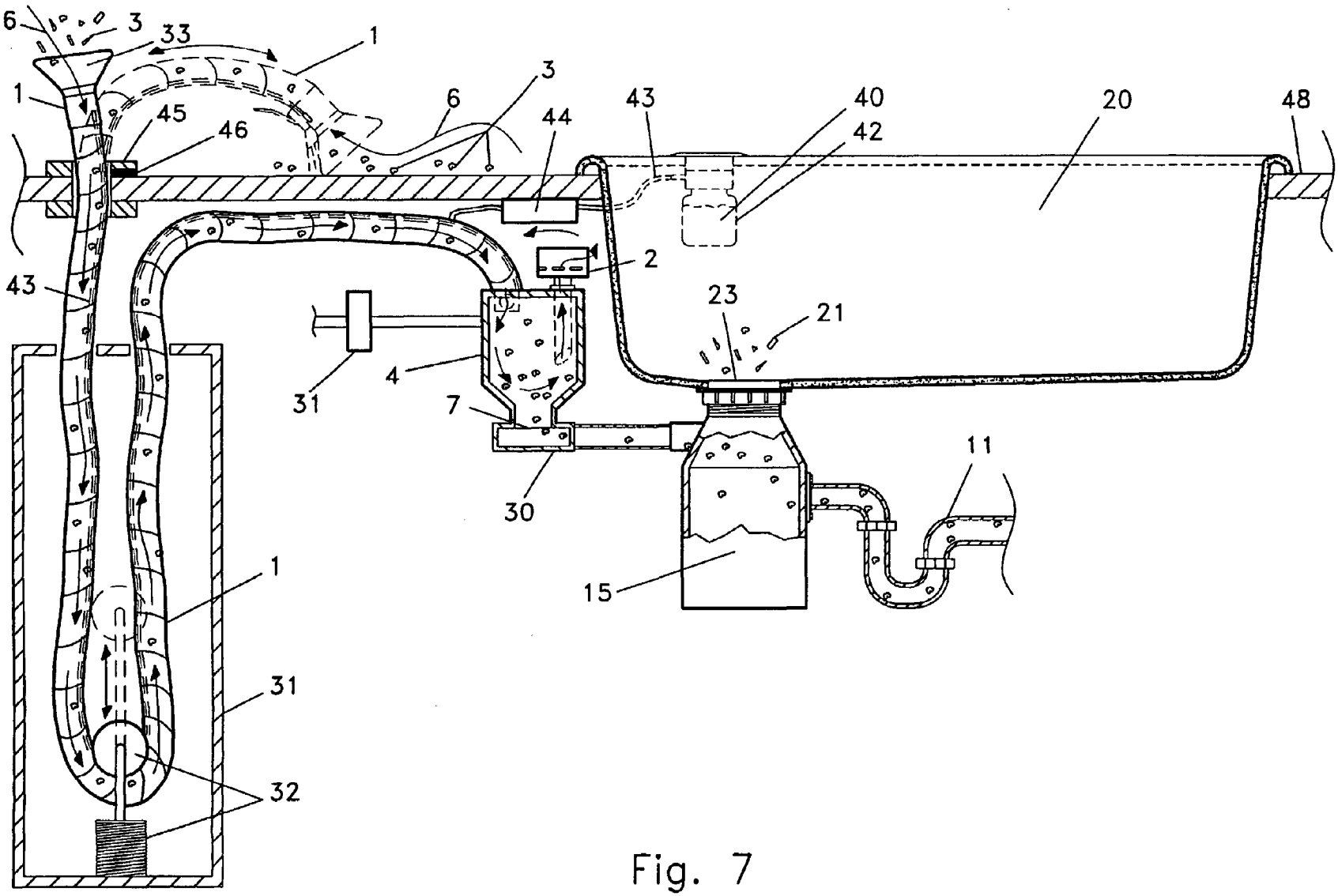
FIG. 7 shows a particular embodiment of the pressure differential material transport system invention in which the material separator collects an amount of material and periodically discharges the collect material to the sewer system or comminutor and with the pressure differential generator located after the airflow outlet of the material separator.

Now referring primarily to FIG. 7, a further embodiment of the invention fluidicly couples the pressure differential generator (2) to the airflow outlet (9) of the material separator (4) to draw airflow (6) through the material separator (4). Material (3) flowable in response to airflow (6) can be separated as discussed above. A closure (30) between the material separator (4) and the comminutor chamber (13) can fluidically seal the material outlet (7) so that airflow cannot be conducted from the comminutor chamber (13) to the material separator (4). The material separator (4) can transfer material (3) collected by opening the closure (30) between the material separator (4) and the comminutor chamber (13). In certain embodiments of the invention, a rinse system (31) delivers water or other liquid to the material separator (4) to assist transfer of separated material (3) to the sewer system (11) or to the comminutor chamber (13).

Again referring to FIG. 7, the various embodiments of the invention can further comprise a storage element (31) into which at least a portion of the material transfer conduit (1) can retract. The retraction mechanism (32) can comprise tensioned reels, pulleys, or other hose guide mechanisms such as those described by U.S. Pat. Nos. 5,156,349; 5,119,843; or 4,903,911; or can comprise motorized rotating rollers such as those disclosed by U.S. Pat. No. 3,911,944, each hereby incorporated by reference. Naturally, various other mechanisms could be used depending on the application to pay out and retract the material transfer conduit (1).

Figure 8:
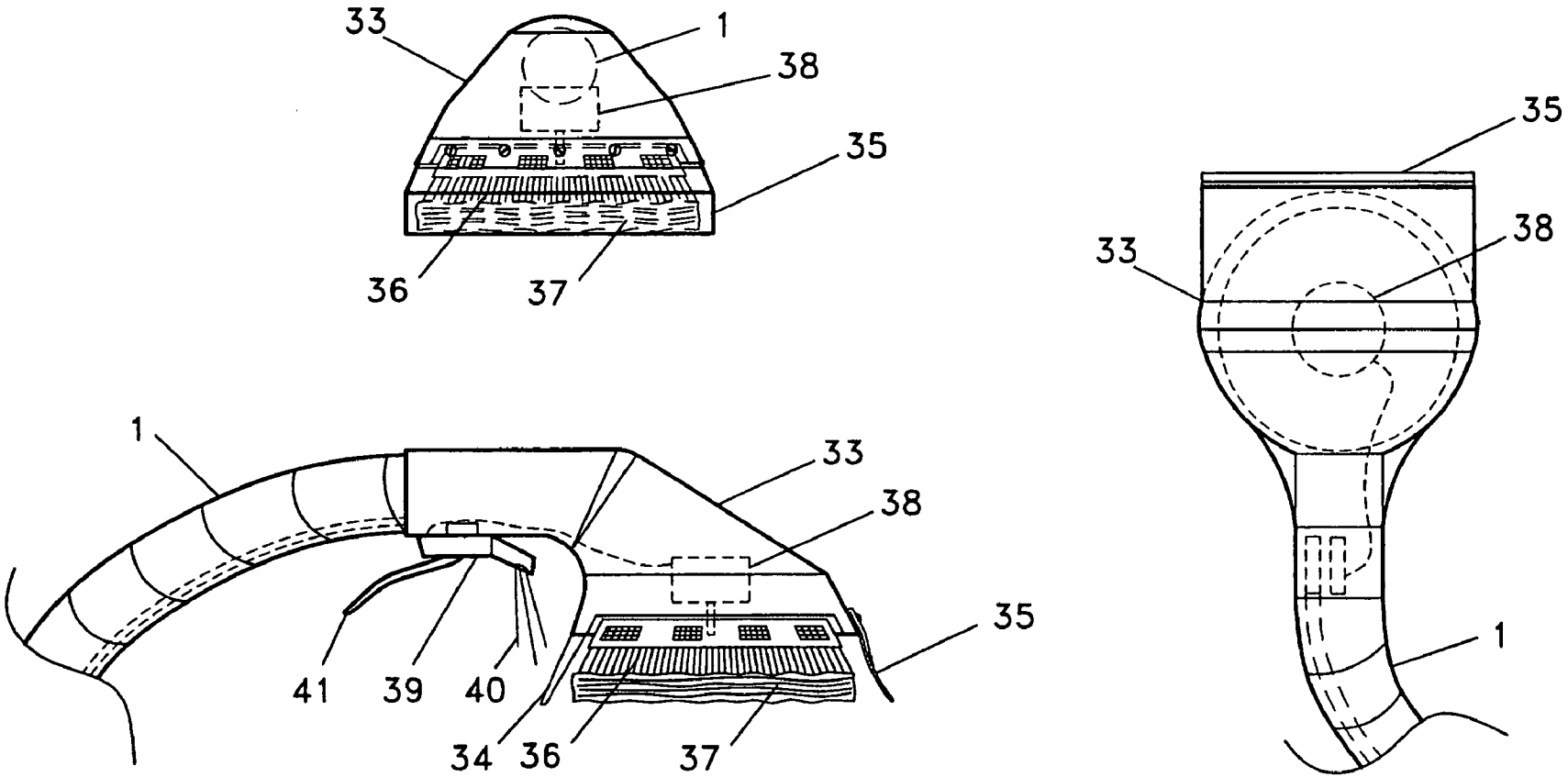
FIG. 8 shows an embodiment of a surface interface element in accordance with the invention having removably coupled brush and pad attachments.

Now referring primarily to FIG. 8, the invention can further comprise a terminal element or surface interface element (33) removably coupled to the material transfer conduit (1). The surface interface element (33) can be configured to conduct airflow (6) across a surface (48) to transfer material (3) from the surface (48) to the airflow (6) within the material transfer conduit (1). The surface interface element can be configured to differentiate material(s) (3) based upon shape, size, or volume. A portion of the surface interface element (33) can be configured to flexibly conform to the surface (48). This can involve a flexibly resilient aperture element (34) that allows the surface interface element (33) to conform to the configuration of the surface or allows the surface to be responsive to altered airflow characteristics such as increased air flow velocity or airflow direction. The flexibly resilient aperture element (34) can further provide enhanced frictional engagement with the surface to manipulate material (3) on the surface, such as the squeegee (35) embodiment of the invention shown in FIG. 8 that can draw liquid material (3) over the surface (20).

Figure 9:
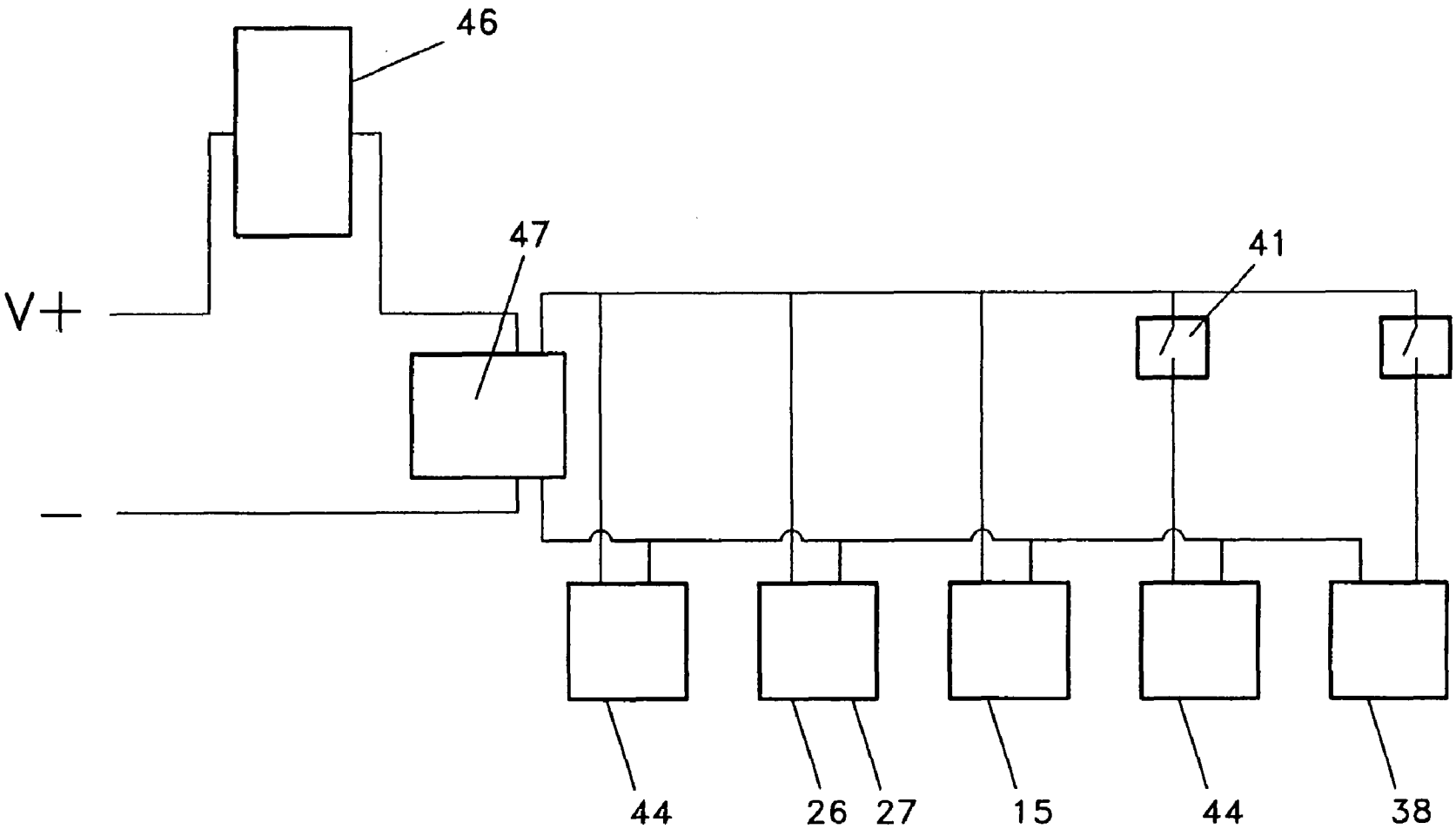
FIG. 9 shows an embodiment of circuitry to provide power to the various components of an embodiment of the invention having a pressure differential generator, comminutor, liquid transfer, and rotatable brush.

The invention can further comprise a brush (36) or a pad (37) that can be used separately or in combination with the surface interface element (33). A brush or pad drive assembly (38) can provide rotation, vibration, oscillation, or reciprocation means coupled to the brush (36) or the pad (37) or to a plurality of brushes or pads. A particular embodiment of the invention as shown by FIG. 9 provides a brush (36) or pad (37) that can be removably coupled to the surface interface element (33). The pad (37) can also be made to removably couple to the brush (36).

In certain embodiments of the invention, a plurality of interchangeable surface interface element(s) (33) can provide various types of surface interface elements (33) harmonized to particular surface types, such as carpet, floors, counter surfaces, glazing, walls, or the like, while other of the interchangeable surface interface elements (33) can be harmonized to the type of application, such as transferring food material from surfaces, cleaning objects or surfaces, buffing objects or surfaces, washing windows, vacuuming, appliance cleaning, or the like.

Now referring primarily to FIGS. 7 and 8, the surface interface element (33) can further comprise a liquid application element (39) (although the liquid application element could also be separate from the liquid application element) through which liquid(s) (40) can be sprayed or dispersed to a surface (20) area responsive to the surface interface element (33). A liquid application actuator element (41) can be coupled to the liquid application element (39) to regulate the flow of a liquid (40) from the liquid application element (39). The liquid (40) dispersed through the liquid application element (39) can comprise water, cleaning solution, polishing solution, or any liquid deliverable and dispersible to a surface including but not limited to, detergent, bleach, anti-microbial, anti-foam, ammonia, or the like.

As further shown by FIG. 7, liquid (40) can be retained for use in a liquid source (42), such as a reservoir, receptacle, or container. A liquid delivery system (44) can transfer the liquid (40) from the liquid source (42) to the to the liquid application element (39) through a liquid transfer conduit (43), which can in some embodiments of the invention traverse the inside of the material transfer conduit (1).

In certain embodiments of the invention, a plurality of liquid delivery systems comprising a plurality of reservoirs, receptacles, or containers can be used contain liquids that can be continuously, or intermittently, dispensed into the stream of liquid delivered to the liquid application actuator element (41). Naturally, these liquids could be injected into the stream of liquid as described above and could comprise any liquid deliverable to and miscible in the liquid stream.

With respect to some embodiments of the invention, the liquid delivery system (44) can comprise an electric liquid pump as shown in FIG. 7 that transfers the liquid (40) from the liquid source (42) to the liquid application element (39) through the liquid transfer conduit (43), however, the liquid delivery system (44) could also comprise applying pressure to the liquid (40) by mechanical means or gas pressure means, sufficient to effect transfer from the liquid (40) from the liquid source (42) to the liquid application element (39). The liquid delivery system (44) could also comprise liquid (40) that flows under pressure in a pipe, such as the hot or cold water plumbed in a residential home. The liquid transfer conduit (43) could be coupled to the to the pipe or plumbing system to allow flow of pressurized liquid (40) in the pipe or plumbing system to flow to the liquid application element (39). As to any of these embodiments of the invention a pressure or volume regulator could be coupled to the liquid transfer conduit to maintain the desired pressure or volume of liquid dispersed by the liquid application element (39) when actuated.

Now referring primarily to FIGS. 3, 6, and 7, the invention can further include a retainer (45) or holder to which the surface interface element can be removably engaged. In certain embodiments of the invention, a pressure differential generator actuator (46) can be built into the retainer (45) such that upon removal of the surface interface element (33) from the retainer (45), the pressure differential generator (2) operates. Similarly, in those embodiments of the invention that include a closure(s) (26)(27) to fluidically isolate the material separator (4) or the comminutor chamber (13), from the sink bowl (20) or the sewer system (11) or both, removal of the surface interface element (33) from the retainer (45) can actuate the closure(s) (26)(27).

Now referring to FIG. 10, electrical circuitry brings power to the pressure differential generator (2), comminutor drive assembly (15), closures (26)(27), liquid delivery system (44), or other electrical components of the invention. As to some embodiments of the invention, the pressure differential generator (2) can be conventionally hard wired in a 110 Volt electrical circuit with a switchable relay (47) responsive to the pressure differential generator actuator (46) to switch current on or off. Parallel circuits can be made responsive to the pressure differential actuator (46) to operate the liquid delivery system (44) so that liquid (40) can be dispersed at the liquid application element (39), or to operate the closure(s) (26)(27) to seal the material transfer system from the sewer system (11), or the sink basin (20), or both. Of course, the power could be transformed to accommodate various types of pressure differential generators, pressurization elements, or comminutor drive assemblies, or otherwise, that may operate at higher or at lower voltage in either direct or alternating currents in two or three phases, depending upon the desired application.

The discussion included in this international Patent Cooperation Treaty patent application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in functionally oriented terminology, each aspect of the function can accomplished by a device, subroutine, or program. Apparatus claims may not only be included for the devices described, but also method or process claims may be included to address the functions the invention and each element performs. Neither the description nor the terminology is intended to limit the scope of the claims.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element that causes that action. Similarly, each physical element disclosed should be understood to encompass a disclosure of the action which that physical element facilitates. Regarding this last aspect, as but one example, the disclosure of a "material separator" should be understood to encompass disclosure of the act of "separating material"—whether explicitly discussed or not—and, conversely, were there only disclosure of the act of "separating material", such a disclosure should be understood to encompass disclosure of an "material separator" and even a "means for separating". Such changes and alternative terms are to be understood to be explicitly included in the description. Additionally, the various combinations and permutations of all elements or applications can be created and presented. All can be done to optimize the design or performance in a specific application.

Any acts of law, statutes, regulations, or rules mentioned in this application for patent, or patents, publications, or other references mentioned in this application for patent, are each hereby incorporated by reference. Specifically, U.S. Provisional Patent Application No. 60/296,824, filed Jun. 8, 2001 is hereby incorporated by reference including any figures or attachments, and each of the references in the following table of references are hereby incorporated by reference.

| DOCUMENT NO. | DATE | NAME | CLASS | SUBCLASS | FILING DATE |
|---|---|---|---|---|---|
| 3,911,944 | Oct. 14, 1975 | Hukuba, et al. | 137 | 355.2 | Apr. 01, 1974 |
| 4,519,896 | May 28, 1985 | Vickery | 209 | 44.1 | Mar. 11, 1982 |
| 4,903,911 | Feb. 27, 1990 | Sepke | 242 | 86 | Oct. 24, 1988 |
| 5,032,256 | Jul. 16, 1991 | Vickery | 209 | 135 | Jan. 03, 1990 |
| 5,060,342 | Oct. 29, 1991 | Brazier | 15 | 322 | Jul. 07, 1988 |
| 5,119,843 | Jun. 09 1992 | Keenan | 137 | 355.23 | Aug. 29, 1991 |
| 5,156,349 | Oct. 20, 1992 | Wilson, et al. | 242 | 47.2 | Nov. 18, 1991 |
| 5,608,945 | Mar. 11, 1997 | Crouser, et al. | 15 | 328 | Jul. 05, 1995 |
| 5,779,744 | Jul. 14, 1998 | Mueller, et al. | 55 | 246 | May 09, 1997 |

-continued

| DOCUMENT NO. | DATE | NAME | CLASS | SUBCLASS | FILING DATE |
|---|---|---|---|---|---|
| 5,924,163 | Jul. 20, 1999 | Burns, Jr. | 15 | 314 | Jun. 13, 1997 |
| 5,954,863 | Sep. 21, 1999 | Loveless, et al. | 96 | 321 | Feb. 19, 1998 |
| 5,974,624 | Nov. 02, 1999 | Eisen | 15 | 353 | Apr .18, 1997 |
| 6,021,545 | Feb. 08, 2000 | Delgado, et al. | 15 | 322 | Apr. 18, 1996 |
| 6,223,361 B1 | May 01, 2001 | Rozenblatt | 4 | 653 | May 13, 1998 |

US Provisional Application, 60/296,824, "Pressure Differential Material Transport and Disposal System", filed Jun. 8, 2001, 11 pages and 8 sheets of drawings.

In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. However, as to each of the above, to the extent that such information or statements incorporated by reference might be considered inconsistent with the patenting of this/these invention(s) such statements are expressly not to be considered as made by the applicant(s).

In addition, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible in countries such as Australia and the like.

Thus, the applicant(s) should be understood to have support to claim at least: i) each of the electrically conductive containers or electrically neutralized containers as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, and x) the various combinations and permutations of each of the elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the subject matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

I claim:

1. A method of disposing of a material, comprising the step of:

a. generating an airflow having airflow characteristics;

b. transferring a material flowable responsive to said airflow having said airflow characteristics from a material location to a material separator;

c. altering said air flow characteristics within said material separator;

d. separating said material from said airflow, wherein said material separates from said airflow due to adjusted air flow characteristics; and e. transferring said material separated from said airflow having adjusted air flow characteristics to a sewage system.

2. A method of disposing of a material as described in claim 1, wherein said sewage system is selected from the group consisting of a septic system, and a municipal sewer system.

3. A method of disposing of a material as described in claim 1, wherein said material is selected from the group consisting of liquids, solids, water, and food.

4. A method of disposing of a material as described in claim 1, wherein said step of altering said air flow characteristics within said material separator comprises altering velocity of said airflow.

5. A method of disposing of a material as described in claim 1, wherein said step of altering said air flow characteristics within said material separator comprises altering direction of said airflow.

6. A method of disposing of a material as described in claim 1, wherein said step of altering said air flow characteristics within said material separator comprises altering volume of said airflow.

7. A method of disposing of a material as described in claim 1, further comprising the step of venting said airflow from said material separator to atmosphere.

8. A method of disposing of a material as described in claim 1, further comprising the step of venting said airflow from said material separator to a vent stack of said sewage disposal system.

9. A method of disposing of a material as described in claim 1, further comprising the step of comminuting said material separated from said airflow.

10. A method of disposing of a material as described in claim 1, further comprising the step of sealing said sewage system during said step of generating an airflow having airflow characteristics.

11. A method of disposing of a material as described in claim 1, further comprising the step conducting said airflow having airflow characteristics to a material location.

12. A method of comminuting a material, comprising the step of:

a. separating a material flowably responsive to an airflow having airflow characteristics, wherein said material separates from said airflow due to alteration of said air flow characteristics;

b. transferring said material separated from said flow of air having adjusted air flow characteristics to a comminutor; and c. comminuting said material transferred to said comminutor.

13. A method of comminuting a material as described in claim 12, further comprising the step of transferring said material separated from said airflow having adjusted airflow characteristics to a sewage system.

14. A method of disposing a flowable material, comprising the step of:

a. providing a material transfer conduit;

b. fluidically coupling a pressure differential generator to said material transfer conduit, wherein upon activation said pressure differential generator establishes an airflow in said material transfer conduit;

c. joining a material separator to said material transfer conduit, wherein said material separator alters characteristics of said airflow; and d. coupling said material separator to a sewage system to receive said material separated from said airflow.

15. A method of disposing a flowable material as described in claim 14, wherein said material separator is configured to alter velocity of said airflow.

16. A method of disposing a flowable material as described in claim 14, wherein said material separator is configured to alter volume of said airflow.

17. A method of disposing a flowable material as described in claim 14, wherein said material separator is configured to alter direction of said airflow.

18. A method of disposing a flowable material as described in claim 14, further comprising the step of transferring said flowable material within said material transfer conduit with said airflow to said material separator.

19. A method of disposing a flowable material as described in claim 14, further comprising the step of providing a storage element into which said material transfer conduit retracts.

20. A method of disposing a flowable material as described in claim 14, further comprising the step of providing a surface interface element coupled to said material transfer conduit.

21. A method of disposing a flowable material as described in claim 20, further comprising the step of flexibly conforming at least a portion of said surface interface element to a surface.

22. A method of disposing a flowable material as described in claim 21, further comprising the step of coupling a liquid application element to said surface interface element.

23. A method of disposing a flowable material as described in claim 22, applying a liquid to said surface from said liquid application element.

24. A method of disposing a flowable material as described in claim 14, further comprising the step of fluidically coupling a comminutor to said material separator.

25. A method of disposing a flowable material as described in claim 24, further comprising the step of comminuting said material separated by said material separator.

26. A method of disposing a flowable material as described in claim 25, further comprising the step of joining a sink basin to said comminutor.

27. A method of disposing a flowable material, comprising the steps of:

a. positioning a material transfer conduit conducting an airflow proximate to a flowable material;

b. introducing said flowable material into said airflow;

c. separating at least a portion of said flowable material from said air flow; and d. transferring said at least a portion of said flowable material separated from said air flow to a sewage system.

28. A method of disposing a flowable material, comprising the steps of:

a. positioning a material transfer conduit conducting an airflow proximate to a flowable material;

b. introducing said flowable material into said airflow;

c. separating at least a portion of said flowable material from said air flow; and d. transferring said at least a portion of said flowable material separated from said air flow to a comminutor.

29. A method of disposing a flowable material as described in claim 28, further comprising the step of transferring said at least a portion of said flowable material separated from said air flow to a sewage system.

30. A waste disposal device, comprising:

a. a comminutor chamber having a comminutor chamber inlet and a comminutor chamber outlet;

b. a comminutor located within said comminutor chamber;

c. a comminutor drive assembly coupled to said comminutor; and d. a material separator fluidically coupled to said comminutor chamber inlet, wherein said material separator has a first inlet configured to fluidicly couple said comminutor chamber to a sink basin and a second inlet coupled to a material transfer conduit through which air flow transfers flowable material which separates from said air flow within said air separator and transfers to said comminutor chamber.

31. A material disposal system as described in claim 30, wherein said comminutor chamber has a substantially vertical cylindrical configuration.

32. A material disposal system as described in claim 31, wherein said comminutor comprises a circular disk rotatable about a vertical axis in said cylindrical comminutor chamber.

33. A material disposal system as described in claim 32, further comprising at least one material comminution element coupled to said circular disk.

34. A material disposal system as described in claim 33, wherein said at least one material comminution element coupled to said circular disk is selected from the group consisting of projections, blades, and centrifugal hammers.

35. A material disposal system as described in claim 34, a screen element having a plurality of apertures located between said inlet and said outlet of said comminuation chamber, wherein said plurality of apertures allow material reduced to a size smaller than the largest of said plurality of apertures to pass through to said outlet.

36. A material disposal system as described in claim 35, wherein said screen element has a location sufficiently close to said at least one comminution element to shear said material between said at least one comminution element and said screen element.

37. A material disposal system as described in claim 30, wherein said comminutor chamber, said comminutor, and said comminutor drive assembly, comprise a garbage disposer.

38. A material disposal system, comprising:

a. a material transfer conduit having an internal volume;

b. a pressure differential generator coupled to said material transfer conduit, wherein said pressure differential generator establishes an airflow having airflow characteristics within said internal volume of said material transfer conduit, and wherein said airflow transfers material flowably responsive to said air flow characteristics through said internal volume of said material transfer conduit;

c. a material separator coupled to said material transfer conduit, wherein said material separator has a configuration which alters said air flow characteristics to allow at least some of said material to separate from said air flow;

d. a sewage system coupled to said material separator, wherein said at least some material transfers to said sewage system for disposal.

39. A material disposal system as described in claim 38, wherein said pressure differential generator establishes a portion of said internal volume of said material transfer conduit.

40. A material disposal system as described in claim 38, wherein said airflow characteristics include velocity of said airflow.

41. A material disposal system as described in claim 38, wherein said airflow characteristics include direction of said airflow.

42. A material disposal system as described in claim 38, wherein said airflow characteristics include volume of said airflow.

43. A material disposal system as described in claim 40, wherein said configuration which alters said airflow characteristics reduces said velocity of said airflow within said material separator.

44. A material disposal system as described in claim 41, wherein said configuration which alters said airflow characteristics changes direction of said airflow toward a surface within said material separator.

45. A material disposal system as described in claim 42, wherein said configuration which alters said airflow characteristics alters the volume of said airflow.

46. A material disposal system as described in claim 43, 44, or 45, wherein said material flowably responsive to said airflow separates from said airflow due to gravitational force.

47. A material disposal system as described in claim 38, wherein said configuration of said material separator has sufficient internal volume to reduce said velocity of said airflow sufficiently to allow said gravitational force to separate said material flowably responsive to said air flow characteristics.

48. A material disposal system as described in claim 38, wherein said material separation element further comprises an airflow outlet to return a portion of said airflow to atmosphere.

49. A material disposal system as described in claim 48, wherein said airflow outlet further comprises a closure sealably responsive to liquid.

50. A material disposal system as described in claim 49, wherein said airflow outlet conducts said portion of said airflow to a sewer ventilation system.

51. A material disposal system as described in claim 38, further comprising a comminutor fluidically coupled to said material separator.

52. A material disposal system as described in claim 51, wherein said comminutor chamber has a substantially vertical cylindrical configuration.

53. A material disposal system as described in claim 52, wherein said comminutor comprises a circular disk rotatable about a vertical axis in said cylindrical comminutor chamber.

54. A material disposal system as described in claim 53, further comprising at least one material comminution element coupled to said circular disk.

55. A material disposal system as described in claim 54, wherein said at least one material comminution element coupled to said circular disk is selected from the group consisting of projections, blades, and centrifugal hammers.

56. A material disposal system as described in claim 55, a screen element having a plurality of apertures located between said inlet and said outlet of said cominuation chamber, wherein said plurality of apertures allow material reduced to a size smaller than the largest of said plurality of apertures to pass through to said outlet.

57. A material disposal system as described in claim 56, wherein said screen element has a location sufficiently close to said at least one comminution element to shear said material between said at least one comminution element and said screen element.

58. A material disposal system as described in claim 57, wherein said comminutor chamber, said comminutor, and said comminutor drive assembly, comprise a garbage disposer.

59. A material disposal system as described in claim 51, further comprising a sink basin coupled to said comminutor, wherein a second material transfer conduit transfers waste material from said sink basin to said comminutor.

60. A material disposal system as described in claim 38, wherein said material flowably responsive to said airflow characteristics is selected from the group consisting of liquids, and solids.

61. A material disposal system as described in claim 59, further comprising a closure operably coupled to said pressure differential generator, wherein said closure seals said comminutor from said sink basin.

62. A material disposal system as described in claim 61, further comprising a sewage system fluidically coupled to said outlet of said comminutor.

63. A material disposal system as described in claim 62, further comprising a second closure operably coupled to said sewage system, wherein said second closure seals said comunuation from said sewage system.

64. A material disposal system as described in claim 63, further comprising a storage element into which at least a portion of said material transfer conduit retracts.

65. A material disposal system as described in claim 64, wherein said material transfer conduit comprises a flexible hose.

66. A material disposal system as described in claim 65, wherein said flexible hose has an external diameter of between about three-quarters inch and about one and one-half inches.

67. A material disposal system as described in claim 66, further comprising a surface interface element fluidically coupled to said material transfer conduit, wherein said surface interface element conducts said airflow across a surface to transfer material flowably responsive to said airflow characteristics from said surface to said airflow within said internal volume of said material transfer conduit.

68. A material disposal system as described in claim 67, wherein said surface interface element has a configuration to differentiate said material based upon material size.

69. A material disposal system as described in claim 68, wherein a portion of said surface interface element flexibly conforms to said surface.

70. A material disposal system as described in claim 69, wherein said portion of said surface interface element that flexible conforms to said surface comprises a squeegee.

71. A material disposal system as described in claim 70, wherein said portion of said surface interface element that flexibly conforms to said surface comprises at least one brush element.

72. A material disposal system as described in claim 71, further comprising a brush drive assembly.

73. A material disposal system as described in claim 72, wherein said brush drive assembly comprises at least one rotation axis about which said at least one brush element rotates; and a brush rotation drive to which said at least one brush element is operably coupled.

74. A material disposal system as described in claim 73, wherein said at least one brush element removably couples to said brush drive assembly.

75. A material disposal system as described in claim 74, further comprising a pad removably coupled to said surface interface element.

76. A material disposal system as described in claim 75, wherein said pad element removably couples to said at least one brush element.

77. A material disposal system as described in claim 66, further comprising a plurality of interchangeable surface interface elements, wherein said plurality of interchangeable surface interface elements conduct said airflow across a surface to transfer material flowably responsive to said airflow characteristics from said surface to said airflow within said internal volume of said material transfer conduit.

78. A material disposal system as described in claim 67, wherein said surface is selected from the group consisting of a table top surface, a counter top surface, a sink surface, a kitchen appliance surface, a floor surface, a carpet surface, a cabinet surface, and a glazing surface.

79. A material disposal system as described in claim 67, further comprising a liquid application assembly comprising:

a. a liquid source;

b. a liquid application element;

c. a liquid transfer conduit between said liquid source and said liquid application element; and d. a liquid delivery system to transfer liquid from said liquid source to said liquid application element through said liquid transfer conduit.

80. A material disposal system as described in claim 79, wherein said liquid application element is coupled to said surface interface element.

81. A material disposal system as described in claim 80, wherein said liquid source comprises a liquid reservoir.

82. A material disposal system as described in claim 79, wherein said liquid delivery system comprises sufficient gas pressure applied to said liquid within said liquid reservoir to transfer said liquid from said liquid source to said liquid application element through said liquid transfer conduit.

83. A material disposal system as described in claim 79, wherein said liquid delivery system comprises an electric pump fluidically coupled to said liquid source and said liquid transfer conduit.

84. A material disposal system as described in claim 79, wherein said liquid source comprises a pressurized water in a pipe.

85. A material disposal system as described in claim 84, wherein said liquid delivery system comprises a coupler element between said water pipe and said liquid transfer conduit through which a part of said pressurized water transfers from said water pipe to said liquid transfer conduit.

86. A material disposal system as described in claim 79, wherein said liquid transfer conduit is routed within said internal volume of said material transfer conduit.

87. A material disposal system as described in claim 79, further comprising a cleaning material soluble in said liquid.

88. A material disposal system as described in claim 87, wherein said cleaning material soluble in said liquid is selected from the group consisting of detergent, bleach, antimicrobial, and ammonia.

89. A material disposal system as described in claim 79, further comprising a pressure differential actuator to activate said pressure differential generator.

90. A material disposal system as described in claim 89, further comprising a surface interface element holder, wherein said surface interface element removably engages with said surface interface element holder.

91. A material disposal system as described in claim 90, wherein said surface interface element holder comprises an annular collar that mates with a handle coupled to said surface interface element.

92. A material disposal system as described in claim 91, wherein said surface interface element holder further comprises said pressure differential generator actuator, whereby said pressure differential generator operates upon removal of said surface interface element from said surface interface element holder, and whereby said pressure differential generator ceases operation upon return of said surface interface element to said surface interface element holder.

* * * * *